United States Patent [19]

Tan et al.

[11] 4,081,360

[45] Mar. 28, 1978

[54] METHOD FOR SUPPRESSING ASPHALTENE FORMATION DURING COAL LIQUEFACTION AND SEPARATION OF SOLIDS FROM THE LIQUID PRODUCT

[75] Inventors: Gim Tan; John G. Gatsis, both of Des Plaines, Ill.

[73] Assignee: UOP Inc., Des Plaines, Ill.

[21] Appl. No.: 755,374

[22] Filed: Dec. 29, 1976

Related U.S. Application Data

[63] Continuation-in-part of Ser. No. 750,480, Dec. 14, 1976, which is a continuation-in-part of Ser. No. 536,680, Dec. 26, 1974, Pat. No. 3,997,425.

[51] Int. Cl.[2] ..... C10G 1/06

[52] U.S. Cl. ..... 208/8; 210/54

[58] Field of Search ..... 208/8, 10; 210/54

[56] References Cited

U.S. PATENT DOCUMENTS

| | | | |
|---|---|---|---|
| 2,476,999 | 9/1949 | Orchin | 208/8 |
| 3,505,203 | 4/1970 | Nelson | 208/8 |
| 3,598,718 | 8/1971 | Gleim et al. | 208/8 |
| 3,607,716 | 9/1971 | Roach | 208/8 |
| 3,607,718 | 9/1971 | Leaders et al. | 208/8 |
| 3,997,425 | 12/1976 | Gatsis et al. | 208/8 |

*Primary Examiner*—Delbert E. Gantz
*Assistant Examiner*—James W. Hellwege
*Attorney, Agent, or Firm*—James R. Hoatson, Jr.; John G. Cutts, Jr.; William H. Page, II

[57] ABSTRACT

A method for suppressing asphaltene formation during coal liquefaction utilizing a hydrogenated coal solvent having been hydrogenated to remove at least about 80% of the asphaltenes which yields as the primary product a mixture of liquid and solids, a part of which is suspended in the liquid. The solids are effectively removed with a minimum loss of desired product and suppressed asphaltene formation by means of a light aromatic solvent in combination with a hydrogenated coal oil solvent having been hydrogenated to remove at least about 80% of the asphaltenes.

4 Claims, 1 Drawing Figure

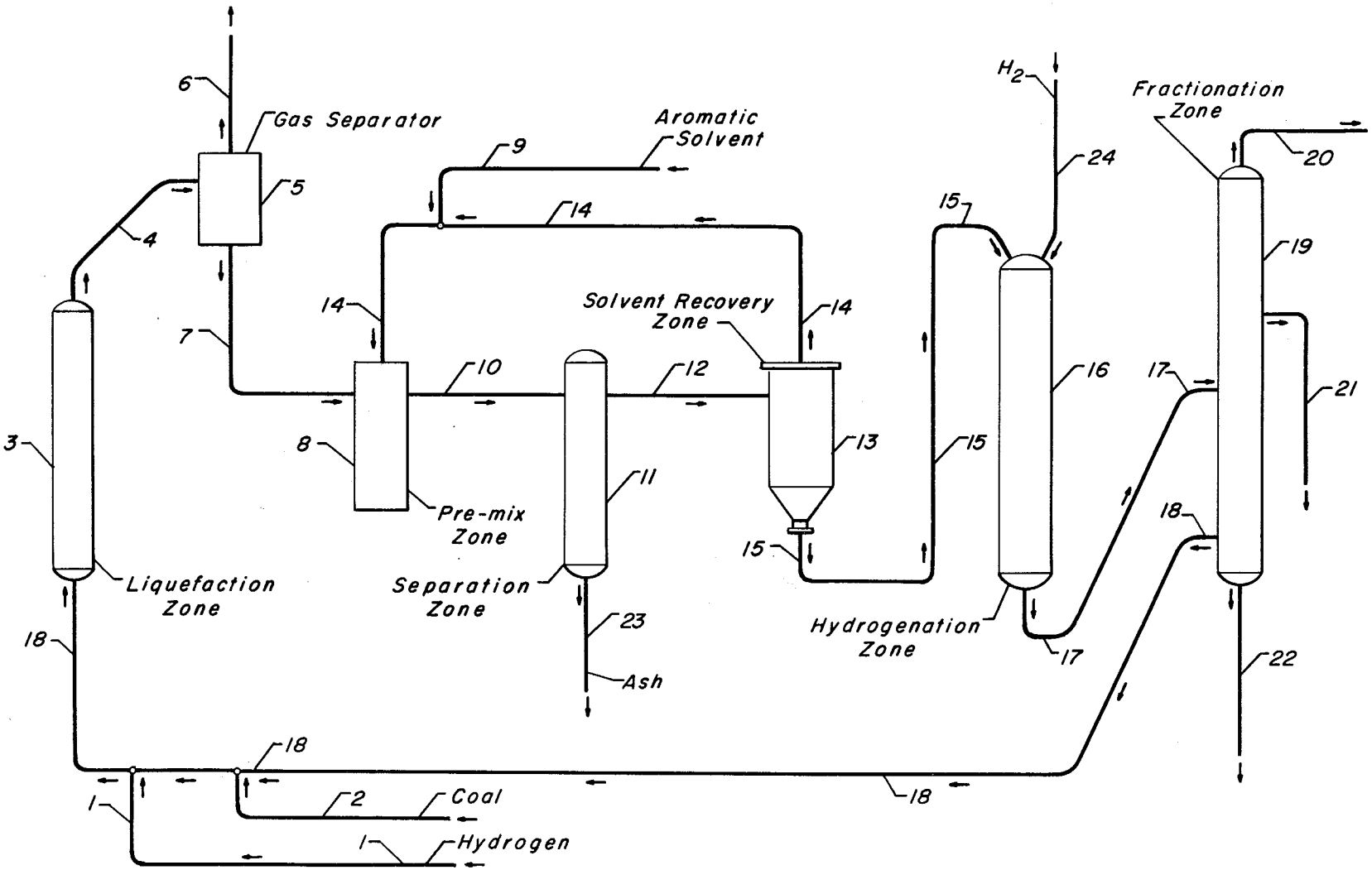
Fractionation Zone
Hydrogenation Zone
Solvent Recovery Zone
Separation Zone
Pre-mix Zone
Liquefaction Zone
Gas Separator
Aromatic Solvent
Ash
Coal
Hydrogen
$H_2$

METHOD FOR SUPPRESSING ASPHALTENE FORMATION DURING COAL LIQUEFACTION AND SEPARATION OF SOLIDS FROM THE LIQUID PRODUCT

CROSS-REFERENCE TO RELATED APPLICATIONS

This application is a continuation-in-part of our application Ser. No. 750,480 filed Dec. 14, 1976 which is a continuation-in-part of our application Ser. No. 536,680, filed Dec. 26, 1974 now U.S. Pat. No. 3,997,425, the teachings of which applications are incorporated herein by specific reference thereto.

BACKGROUND OF THE INVENTION

This invention relates to a process for the conversion of coal to a clean fuel, that is, a fuel which is substantially free of the mineral components normally found in coal.

In particular, the invention relates to a method for suppressing asphaltene formation during coal liquefaction wherein a hydrogenated coal solvent having been hydrogenated to remove at least about 80% of the asphaltenes and hydrogen are present during the liquefaction of the coal. The primary product of the coal liquefaction process is a mixture of liquid and undissolved solids. Some gas is generally also produced. A portion of the undissolved solids appears as extremely finely divided particles of the order of ten microns or less in size. These particles are rich in mineral matter normally found in all coals. Combustion of fuel containing these particles forms ash.

Complete separation of such finely divided particles from the liquid in which they are suspended cannot be accomplished by the usual mechanical separation techniques at ordinary temperatures, which techniques include filtration, centrifugation, and settling, because of the extremely fine state of subdivision of the solid particles and because of the high viscosity of the liquid. Separation is improved by operation at elevated temperatures due to a rapid decrease in liquid viscosity, as well as an increase in the density differential between liquid and solid. Even at these elevated temperatures and reduced viscosities, the conventional separation techniques may be only partially effective.

SUMMARY OF THE INVENTION

An object of the present invention is to provide a novel process for the liquefaction of carbonaceous solids such as coal in order to produce valuable hydrocarbonaceous products.

Another object of the present invention is to provide a process for the separation of finely divided particulate matter from coal extract.

Yet another object of the present invention is to provide a process which retards the formation and growth of asphaltenes thereby permitting a higher recovery of valuable products.

A particular object of the present invention is to provide a method for suppressing asphaltene formation during coal liquefaction using a particular method for liquefying and recovering the coal extract in which the coal is liquefied with a hydrogenated coal solvent having been hydrogenated to remove at least about 80% of the asphaltenes in the presence of hydrogen and in which the finely divided particulate removal is enhanced by the presence of a light aromatic solvent and a hydrogenated coal solvent having been hydrogenated to remove at least about 80% of the asphaltenes.

In an embodiment, the present invention relates to a method for suppressing asphaltene formation during coal liquefaction which comprises the steps: (a) contacting the coal at a temperature of from about 150° C. to about 450° C. and a pressure of from about 10 to about 300 atmospheres with a hydrogenated coal oil solvent having been hydrogenated to remove at least about 80% of the asphaltenes and hydrogen; (b) separating gas from the resultant mixture to provide a liquid phase comprising coal extract, liquefaction zone effluent solvent and finely divided particles; and (c) supplying said liquid phase including substantially all of said liquefaction zone effluent coal oil solvent to a pre-mix zone and therein commingling the same with from about 10 weight percent to about 1000 weight percent of a light aromatic solvent selected from the group consisting of benzene, toluene and xylene at a temperature of from about 10° C. to about 150° C. and a pressure of from about atmospheric to about 25 atmospheres.

We have found that coal and other similar carbonaceous solids can be liquefied to produce valuable hydrocarbonaceous products by treating the coal with a hydrogenated coal solvent having been hydrogenated to remove at least about 80% of the asphaltenes and hydrogen, and then adding a light aromatic solvent before the separation of ash from the coal extract. Superior ash separation and the minimization of asphaltene formation thereby results from our invention.

It is well known that raw coal liquefaction products contain what are commonly referred to as "asphaltenes". Traditionally asphaltenes have been defined as hydrogen-deficient high molecular weight hydrocarbonaceous materials which are insoluble in straight chain aliphatic hydrocarbons such as n-pentane or n-heptane. We now recognize that the broad term asphaltenes relates to a wide spectrum of hydrocarbonaceous materials which may be further characterized. A heptane insoluble asphaltene may be further extracted by using benzene, chloroform and DMF (dimethyl formamide) solvents in that order. The benzene soluble asphaltenes are characterized with a high proportion of molecules having a molecular weight in the range of from about 450 to about 650 and only mildly hydrogen-deficient. The chloroform soluble asphaltenes are characterized with a high proportion of molecules having a molecular weight in the range of from about 1000 to about 1200. The DMF soluble asphaltenes are characterized with a high proportion of molecules having a molecular weight in the range from about 1800 to about 2000 and are severely hydrogen deficient. In a typical coal liquefaction extract the benzene, chloroform and DMF soluble asphaltene fractions would be expected to be about 50, 35 and 15 volume percent, respectively, of the heptane insoluble asphaltene fraction.

Although the exact mechanism of the asphaltene conversion in a hydrogenation zone is not known for certain, we believe that the higher molecular weight asphaltenes are converted to lower molecular weight asphaltenes and that the original lower molecular weight asphaltenes are converted to distillates. This theory is the antithesis of any speculation that the higher molecular weight asphaltenes are converted directly to distillates. The least nocuous of these asphaltenes are the benzene soluble asphaltenes which may be satisfactorily processed in conventional downstream petroleum refining processes. The benzene soluble asphaltenes also have the least propensity to coke or to promote further growth of larger asphaltenes, have the highest hydrogen to hydrocarbon ratio and perform as the best coal liquefaction solvent as compared to any other types of asphaltenes.

Therefore, when we refer to a hydrogenated coal solvent having been hydrogenated to remove at least about 80% of the asphaltenes we mean a solvent which has been hydrogenated to remove essentially all of the chloroform and DMF soluble asphaltenes while permitting the presence of a small percentage of the relatively innocuous benzene insoluble asphaltenes. We have discovered that the presence of up to about 3 weight percent of these lower molecular weight asphaltenes has no deleterious effect on the liquefaction, separation or downstream processing steps of the present invention. Typically, when at least about 80% of the asphaltenes are removed from a coal liquefaction extract via hydrogenation, less than about 3 weight percent of the hydrogenated coal oil solvent is benzene soluble asphaltenes with essentially no chloroform or DMF soluble asphaltenes present.

The coal was pulverized to provide particles sufficiently small to pass through a 200 mesh Tyler screen. 100 grams of the pulverized coal, two hundred grams of previously extracted hydrogenated coal oil solvent having been hydrogenated to remove at least about 80% of the asphaltenes and hydrogen were admixed in a liquefaction zone at a pressure of 2500 psig., a temperature of 420° C. (788° F.), a solvent to coal ratio of 2:1 by weight, with a liquid hourly space velocity (LHSV) of 0.8.

DESCRIPTION OF THE DRAWING

The attached drawing is a schematic illustration of one preferred embodiment of the process of the present invention. The scope of the present invention is not limited to the embodiment shown. Various other suitable embodiments will be apparent to those skilled in the art from the drawing and following description thereof and from the detailed description of the invention provided hereinafter.

Referring to the drawing, hydrogen is introduced into the operation via conduit 1 and passed into conduit 18 which contains a hydrogenated coal solvent having been hydrogenated to remove at least about 80% of the asphaltenes and described hereinafter. Comminuted coal is passed into conduit 18 via conduit 2. The coal is comminuted to sufficiently small size to pass through a 200 mesh Tyler sieve, or finer, before being passed into conduit 2. The coal, hydrogen and coal solvent are then passed via conduit 18 into liquefaction zone 3. The coal is processed in liquefaction zone 3 at a pressure of from about 1000 psig. to about 7000 psig., at a temperature of from about 350° C. to about 500° C., a space velocity of from about 0.2 to about 8, with a hydrogen circulation rate of from about 10,000 to about 300,000 standard cubic feet per ton of coal, and with a solvent to coal weight ratio of from about 1:1 to about 4:1. The treated mixture is passed out of liquefaction zone 3 through conduit 4 into gas separator 5. In gas separator 5 unconsumed hydrogen and any other gases present are separated from the liquid and are passed out of gas separator 5 via conduit 6. The nongaseous components are passed out of gas separator 5 via conduit 7 into pre-mix zone 8. Makeup aromatic solvent is introduced to the operation via conduit 9 and is passed into conduit 14, which contains a recycle aromatic solvent stream described hereinafter. Suitable low boiling range aromatic solvents are benzene, toluene, xylene, etc. The aromatic solvent is then intimately mixed with the above-mentioned nongaseous components. The mixture is passed out of pre-mix zone 8 via conduit 10 into separation zone 11. In separation zone 11, solid materials are removed by conventional means for removing solids from liquids, such as centrifugation, filtration, etc. The ash and any other solid materials, such as undissolved organic components of the coal, are withdrawn from separation zone 11 via conduit 23 and are passed out of the operation. The solid-free liquid is passed out of separation zone 11 via conduit 12 into solvent recovery zone 13 which consists of any suitable fractionator for fractionally distilling relatively high boiling liquids. The primary function of the fractionator is to recover aromatic solvent from the solid-free liquid. Recovered aromatic solvent is passed from solvent recovery zone 13 via conduit 14 and recycled to pre-mix zone 8 for further use as described above. The desired low mineral content extract is passed from solvent recovery zone 13 via conduit 15 into hydrogenation zone 16. In the hydrogenation zone, the clarified extract is contacted with hydrogen, introduced by means of conduit 24, and a suitable hydrogenation catalyst. Such catalysts are well known in the art and may contain nickel, molybdenum, cobalt, palladium, and tungsten on various porous inorganic supports, such as kieselguhr, alumina, silica, mordenite, faujasite, etc.

The clarified extract may be processed upflow, downflow, or in a slurry. Hydrogenation is preferably in the liquid phase, but may be in the mixed phase or vapor phase. Preferably, the hydrogenation reaction performed in hydrogenation zone 16 occurs under hydrogenation conditions which include a temperature from about 600° F. to about 900° F. preferably about 725° F., a pressure from about 1000 to about 5000 psig., a liquid hourly space velocity from about 0.5 to about 5, and a hydrogen circulation rate from about 3000 to about 10,000 S.C.F.B.

The products of the hydrogenation zone are removed via conduit 17 and introduced into a fractionation zone 19, where the clarified hydrogenated products are fractionated into a plurality of various product streams which are removed via conduits 20, 21 and 22 for further conventional refining or for use as a fuel or petrochemical feed stock, as desired. Another hydrogenated coal oil stream having been hydrogenated to remove at least about 80% of the asphaltenes is passed from fractionation zone 19 via conduit 18 for recycle to liquefaction zone 3.

DETAILED DESCRIPTION OF THE INVENTION

The carbonaceous, solid materials which can be treated in the present process include any sort of coal, e.g., bituminous coal, lignite, sub-bituminous coal, etc. Other solid carbonaceous materials such as peat, oil shale, tar sand and the like may also be utilized, but may not necessarily give equivalent results. The preferred carbonaceous solid is a bituminous coal. For example, an Illinois Bellville district stoker coal having a moisture and ash free (MAF) volatile content of about 20% or higher is particularly suitable. Although not essential, it is preferred that the coal to be employed in the operation is first reduced to a particulate, comminuted form. Preferably, the coal is ground or pulverized to provide particles sufficiently small to pass through a 100 mesh Tyler sieve or smaller. Coal which is ground sufficiently fine to pass through a 200 mesh Tyler sieve is particularly preferred for use.

Liquefaction conditions employed in treating the solid coal in the liquefaction step include a temperature range from about 650° F. to about 900° F. and a pressure from about 500 psig. to about 5000 psig. The hydrogen circulation rate may be fairly low, and may suitably range from about 1000 to about 20,000 S.C.F.B. of coal slurry charge. The solvent to coal weight ratio may suitably range from about 0.5:1 to about 5:1 and the liquid hourly space velocity ranges from about 0.5 to about 5.

The coal liquefaction step in the present process may be performed in a batch type operation or a continuous type operation. When a batch operation is employed, fixed amounts of the coal, hydrogen and coal oil solvent are charged to a suitable conventional coal liquefaction reactor, such as a rocking autoclave. The reactants are contacted in the liquefaction reactor for a period of time sufficient to produce the desired amount of conversion and then the mixture is withdrawn from the liquefaction zone. A suitable contact time in a batch type operation is from about 0.5 hour to about 3 hours, preferably, from about 1 hour to about 2 hours. In a continuous type operation, the coal, hydrogen and coal solvent are continuously charged to a suitable conversion zone which may be of any type known in the art, and the reactants are contacted therein. The resulting mixture is continuously withdrawn from the reactor. A liquid hourly space velocity (LHSV) in a continuous type operation (defined as volume of the reactor divided by the total volume of the reactants charged per hour) of about 0.5 to about 5 may be employed, and a LHSV of about 0.6 to about 1.5 is particularly preferred.

The liquefaction zone or reactor utilized in the solid coal conversion step of the present process may be any suitable vessel or reactor which can maintain the reactants at the desired temperature and pressure in order to provide the required liquefaction conditions. For example, a conventional rocking autoclave is a suitable reactor for use in a batch type process. A variety of vessels suitable for use in the solid coal conversion step in the present process are known in the art of coal liquefaction. Preferably, the conversion zone includes some means for admixing the reactants, such as by stirring or other agitation.

The mixture recovered from the liquefaction zone includes hydrocarbonaceous material and ash. The hydrocarbonaceous phase recovered from the conversion step comprises a material which is generally liquid at room temperature and which has an ash content and a sulfur content significantly lower than the inorganic content and the sulfur content, respectively, of the untreated bituminous coal. One of the major drawbacks encountered in prior art coal liquefaction operations has been the difficulty of separating ash from the liquefied hydrocarbonaceous materials after liquefaction. By using a hydrogenated coal oil solvent having been hydrogenated to remove at least about 80% of the asphaltenes in the liquefaction step and by contacting the resulting hydrocarbonaceous extract, in the presence of the coal oil solvent, with a low boiling range aromatic solvent, the present process significantly reduces the amount of asphaltenes present in the liquefied hydrocarbonaceous phase recovered in the separation zone, since the hydrogenated solvent tends to retard or inhibit the initial formation and growth of asphaltenic materials during the liquefaction step and the light aromatic solvent addition in a pre-mix zone unexpectedly promotes the separation of ash from the hydrocarbonaceous extract.

The hydrocarbonaceous phase recovered by separating the ash from the mixture resulting from the solid coal conversion operation comprises a material which is generally liquid at room temperature when a bituminous coal is used. This hydrocarbonaceous phase comprises a mixture of various hydrocarbonaceous compounds containing about 86–90 weight percent carbon and about 7–9 weight percent hydrogen. This recovered hydrocarbonaceous phase is further treated in a solvent recovery zone to recover the light aromatic solvent which may be recycled to the hereinabove mentioned pre-mix zone. A suitable solvent recovery zone may include a fractionation zone or any other technique for separating light aromatic hydrocarbons from coal liquefaction product.

At least a portion of the low mineral content extract is hydrogenated to provide a valuable hydrocarbonaceous product and to supply the hydrogenated coal oil solvent having been hydrogenated to remove at least about 80% of the asphaltenes which is used in the initial liquefaction step.

The following example is presented in illustration of the preferred embodiment and is not intended as an undue limitation on the generally broad scope of the invention as set out in the appended claims.

EXAMPLE

A seam coal from Randolph Co., Bellville District, Ill., was analyzed to determine its average composition, which was found to be as shown in Table I.

TABLE I

| | Wt. % |
|---|---|
| Ash | 10.18 |
| Total Nitrogen | 1.32 |
| Leco Sulfur | 3.34 |
| Total Oxygen | 9.54 |
| Free Water | 4.00 |
| Volatiles | 39.72 |
| Carbon | 64.45 |
| Hydrogen | 5.25 |
| Dry Ash | 10.70 |

The coal was pulverized to provide particles sufficiently small to pass through a 200 mesh Tyler screen. A mixture of pulverized coal, previously extracted hydrogenated coal oil solvent having been hydrogenated to remove at least about 80% of the asphaltenes and hydrogen was charged to a liquefaction zone maintained at the following conditions: a pressure of 2500 psig., a temperature of 420° C. (788° F.), a solvent to coal ratio of 2:1 by weight, a liquid hourly space velocity (LHSV) of 0.8 $hr.^{-1}$ and a hydrogen circulation rate of 10,000 standard cubic feet per barrel of coal slurry. The effluent from the liquefaction zone was admitted to a gas separator to remove unconsumed hydrogen and any other gas present. The liquid coal slurry recovered from the gas separator was admixed with toluene solvent to provide a solvent to slurry ratio of 3.5:1 by weight.

The mixture of toluene and coal slurry was charged to a separation zone comprising a centrifuge which is operated at a temperature of 75° C. and a pressure of 100 psig. to remove ash and unconverted coal from the valuable liquid hydrocarbons. Said liquid hydrocarbons were admitted to a solvent recovery zone which is maintained at a temperature sufficient to recover the toluene solvent. The resulting ash-free, solvent-free hydrocarbon stream is charged to a hydrogenation zone which contains a cobalt-molybdenum-alumina catalyst and which is maintained at the following conditions: a pressure of 2000 psig., a temperature of 735° F., a liquid hourly space velocity of 1.0 $hr.^{-1}$ and a hydrogen circulation rate of 9000 S.C.F.B. The resulting hydrogenated hydrocarbon was recovered as product which contained 89.8% carbon and 9.3% hydrogen. A portion of the product was recycled to provide the hydrogenated coal oil solvent having been hydrogenated to remove at least about 80% of the asphaltenes used in the liquefaction zone. The recovered product represented a 70% recovery of the coal charged to the liquefaction zone.

The foregoing specification and illustrative example clearly indicate the means by which the present invention is effected, and the benefits afforded through the utilization thereof.

We claim as our invention:

1. A method for suppressing asphaltene formation during coal liquefaction which comprises the steps of:

(a) contacting the coal at a temperature of from about 150° C. to about 450° C. and a pressure of from about 10 to about 300 atmospheres with hydrogen and a hydrogenated coal oil solvent having been hydrogenated to remove at least about 80% of the asphaltenes and containing a small amount, up to 3 wt. %, of benzene soluble asphaltenes;

(b) separating gas from the resultant mixture to provide a liquid phase comprising coal extract, liquefaction zone effluent solvent and finely divided particles;

(c) commingling said liquid phase with from about 10 wt. % to about 1000 wt. % of a light aromatic solvent selected from the group consisting of benzene, toluene and xylene at a temperature of from about 10° C. to about 150° C. and a pressure of from about atmospheric to about 25 atmospheres;

(d) separating solids and light aromatic solvent from the resultant liquid mixture;

(e) hydrogenating at least a portion of the remaining liquid mixture to remove at least about 80 percent of the asphaltenes; and (f) supplying resultant hydrogenated liquid to step (a) as said coal oil solvent.

2. The process of claim 1 further characterized in that said light aromatic solvent is benzene.

3. The process of claim 1 further characterized in that said light aromatic solvent is toluene.

4. The process of claim 1 further characterized in that said light aromatic solvent is xylene.

* * * * *